US009689362B2

(12) United States Patent
Sato et al.

(10) Patent No.: US 9,689,362 B2
(45) Date of Patent: Jun. 27, 2017

(54) FUEL INJECTION VALVE EQUIPPED WITH IN-CYLINDER PRESSURE SENSOR

(71) Applicant: KEIHIN CORPORATION, Shinjuku-ku, Tokyo (JP)

(72) Inventors: Gaku Sato, Tochigi (JP); Yuki Kojima, Tochigi (JP); Nakaya Nakamura, Tochigi (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 15/291,411

(22) Filed: Oct. 12, 2016

(65) Prior Publication Data

US 2017/0030313 A1 Feb. 2, 2017

Related U.S. Application Data

(62) Division of application No. 14/381,842, filed as application No. PCT/JP2013/053649 on Feb. 15, 2013, now Pat. No. 9,494,095.

(30) Foreign Application Priority Data

Feb. 29, 2012 (JP) ..... 2012-043886

(51) Int. Cl.
*F02M 57/00* (2006.01)
*F02M 61/14* (2006.01)
(Continued)

(52) U.S. Cl.
CPC ..... *F02M 57/005* (2013.01); *F02B 77/085* (2013.01); *F02D 41/1439* (2013.01);
(Continued)

(58) Field of Classification Search
CPC .... F02D 41/1439; F02D 35/023; F02D 41/30; F02M 2200/247; F02M 57/005;
(Continued)

(56) References Cited

U.S. PATENT DOCUMENTS 8,469,006 B2 6/2013 Cooke
2006/0169244 A1* 8/2006 Allen ..... F02D 35/021 123/297

(Continued)

FOREIGN PATENT DOCUMENTS

JP H09-53483 A 2/1997

*Primary Examiner* — Jacob Amick
(74) *Attorney, Agent, or Firm* — Carrier Blackman & Associates, P.C.; William D. Blackman; Joseph P. Carier

(57) ABSTRACT

A fuel injection valve equipped with an in-cylinder pressure sensor is provided, in which the fuel injection valve is fitted into an injection valve mounting hole provided in an engine, the in-cylinder pressure sensor is attached to a valve housing part of the fuel injection valve, the in-cylinder pressure sensor having a front end facing the combustion chamber and detecting a pressure of the combustion chamber, and a signal transmission device is connected to the in-cylinder pressure sensor, the signal transmission device transmitting an output signal thereof to an outside. The signal transmission device is disposed on the valve housing part and covered together with a part of the valve housing part by an insulating layer. In such arrangement, the signal transmission device is protected by the insulating layer, and a contact between the signal transmission device and an inner face of the injection valve mounting hole is prevented.

2 Claims, 3 Drawing Sheets

(51) Int. Cl.

| | |
|---|---|
| ***F02D 41/14*** | (2006.01) |
| ***F02D 41/30*** | (2006.01) |
| ***F02B 77/08*** | (2006.01) |
| ***F02M 61/04*** | (2006.01) |
| ***F02M 61/16*** | (2006.01) |

(52) U.S. Cl.
CPC ..... *F02D 41/30* (2013.01); *F02M 61/04* (2013.01); *F02M 61/14* (2013.01); *F02M 61/166* (2013.01); *F02M 2200/247* (2013.01)

(58) Field of Classification Search
CPC ..... F02M 61/14; F02M 61/04; F02M 61/166; F02B 77/085
See application file for complete search history.

(56) References Cited

U.S. PATENT DOCUMENTS

| | | | | |
|---|---|---|---|---|
| 2007/0039592 | A1 | 2/2007 | Kull | |
| 2010/0050991 | A1* | 3/2010 | Cooke ..... | F02M 51/005 123/470 |
| 2014/0048041 | A1 | 2/2014 | Akazaki et al. | |

* cited by examiner 15
1
25
23
11
2
27
28
29
30
13
14
10
12

FUEL INJECTION VALVE EQUIPPED WITH IN-CYLINDER PRESSURE SENSOR

CROSS-REFERENCE TO RELATED APPLICATIONS

This application is a divisional application of the U.S. patent application Ser. No. 14/381,842, filed on Aug. 28, 2014, which is US National Phase Application of the International Application No. PCT/JP2013/053649, filed on Feb. 15, 2013, and which claims priority from the Japanese Patent Application No. 2012-043886, filed on Feb. 29, 2012. The entire contents of these prior applications are incorporated herein by reference.

TECHNICAL FIELD

The present invention relates to an improvement of a fuel injection valve equipped with an in-cylinder pressure sensor in which a fuel injection valve is fitted into an injection valve mounting hole provided in an engine, the fuel injection valve directly injecting fuel from a front end of a valve housing into a combustion chamber of the engine, an in-cylinder pressure sensor is attached to the valve housing, the in-cylinder pressure sensor detecting a pressure of the combustion chamber, and signal transmission means is connected to the in-cylinder pressure sensor, the signal transmission means transmitting an output signal thereof to an outside.

BACKGROUND ART

Such a fuel injection valve equipped with an in-cylinder pressure sensor is already known, as disclosed in Patent Document 1.

RELATED ART DOCUMENTS

Patent Documents

Patent Document 1: Japanese Patent Application Laid-open No. 9-53483

SUMMARY OF THE INVENTION

Problems to be Solved by the Invention

In the fuel injection valve equipped with an in-cylinder pressure sensor described in Patent Document 1, as signal transmission means for transmitting an output signal from an in-cylinder pressure sensor to the outside, a lead is connected to the in-cylinder pressure sensor, and this is pulled outside while carrying out wiring on one side of a fuel injection valve within an injection valve mounting hole of an engine.

In such an arrangement the lead, which has flexibility, vibrates upon being subjected to vibration of the engine, and there is a possibility that it will make contact with an inner face of the injection valve mounting hole and be damaged.

The present invention has been accomplished in light of such circumstances, and it is an object thereof to provide a fuel injection valve equipped with an in-cylinder pressure sensor in which signal transmission means connected to an in-cylinder pressure sensor does not vibrate within an injection valve mounting hole, thus enabling its durability to be ensured.

Means for Solving the Problems

In order to attain the above object, according to a first aspect of the present invention, there is provided a fuel injection valve equipped with an in-cylinder pressure sensor in which a fuel injection valve is fitted into an injection valve mounting hole provided in an engine, the fuel injection valve directly injecting fuel from a front end of a valve housing part into a combustion chamber of the engine, an in-cylinder pressure sensor is attached to the valve housing part, the in-cylinder pressure sensor detecting a pressure of the combustion chamber, and signal transmission means is connected to the in-cylinder pressure sensor, the signal transmission means transmitting an output signal thereof to an outside, characterized in that the in-cylinder pressure sensor, which is cylindrical and has a front end facing the combustion chamber, and a cylindrical signal circuit tube, as part of the signal transmission means, fitted and connected to an inner peripheral face of a rear end of the in-cylinder pressure sensor are fitted and fixed to an outer peripheral face of the valve housing part, housed in the injection valve mounting hole, of the fuel injection valve.

Further, according to a second aspect of the present invention, in addition to the first aspect, an insulating layer covering the signal circuit tube is formed on an outer periphery of the fuel injection valve.

Furthermore, according to a third aspect of the present invention, in addition to the second aspect, a support ring abutting against a rear end face of the in-cylinder pressure sensor is hermetically fitted around an outer peripheral face of a front end part of the insulating layer, and this support ring is welded to the rear end of the in-cylinder pressure sensor.

According to a fourth aspect of the present invention, a fuel injection valve is equipped with an in-cylinder pressure sensor, in which the fuel injection valve is fitted into an injection valve mounting hole provided in an engine, the fuel injection valve directly injecting fuel into a combustion chamber of the engine, the in-cylinder pressure sensor is attached to a valve housing part of the fuel injection valve, the in-cylinder pressure sensor having a front end facing the combustion chamber and detecting a pressure of the combustion chamber, and a signal transmission device is connected to the in-cylinder pressure sensor, the signal transmission device transmitting an output signal thereof to an outside, wherein the signal transmission device is disposed on an outer face of the valve housing part and covered together with a part of the valve housing part by an insulating layer made of a synthetic resin.

Further, according to a fifth aspect of the present invention, in addition to the fourth aspect, the insulating layer forms at least a part of a coupler, and a power supply terminal for energizing a coil and a signal terminal for transmitting an output signal are disposed in the coupler.

Effects of the Invention

In accordance with the first aspect of the present invention, due to the cylindrical in-cylinder pressure sensor, which has the front end facing the combustion chamber, and the cylindrical signal circuit tube, as part of the signal transmission means, which is fitted and connected to the inner peripheral face of the rear end part of the in-cylinder pressure sensor, being fitted around and fixed to the outer peripheral face of the valve housing part, housed in the injection valve mounting hole, of the fuel injection valve, it is unnecessary to employ special positioning when fitting and connecting together the in-cylinder pressure sensor and the signal circuit tube, which are both cylindrical, and the ease of assembly is good. Moreover, since the signal circuit tube fitted around the outer peripheral face of the valve housing part does not vibrate even when subjected to vibration of the engine, even if it is housed within the injection valve mounting hole, it does not make contact with the inner face of the injection valve mounting hole, thus enabling the durability thereof to be maintained.

In accordance with the second aspect of the present invention, due to the insulating layer covering the signal circuit tube being formed on the outer periphery of the fuel injection valve, it is possible by this insulating layer to reliably prevent the signal circuit tube from making contact with the inner face of the injection valve mounting hole while protecting the signal circuit tube.

In accordance with the third aspect of the present invention, due to the support ring abutting against the rear end face of the in-cylinder pressure sensor being hermetically fitted around the outer peripheral face of the front end part of the insulating layer and due to this support ring being joined to the rear end of the in-cylinder pressure sensor by the circumferential weld, it is possible to enhance the support strength for the in-cylinder pressure sensor and it is also possible to ensure a sealed state between the support ring and the insulating layer and in-cylinder pressure sensor.

In accordance with the fourth aspect of the present invention, it is possible to protect the signal transmission device by means of the insulating layer, and also to prevent contact between the signal transmission device and an inner face of the injection valve mounting hole are achieved.

In accordance with the fifth aspect of the present invention, it is possible to protect the whole signal transmission device extending from a connection part thereof with the sensor to a part thereof where the device transmits the output signal of the sensor to an outside.

EXPLANATION OF REFERENCE NUMERALS AND SYMBOLS

Figure 1:
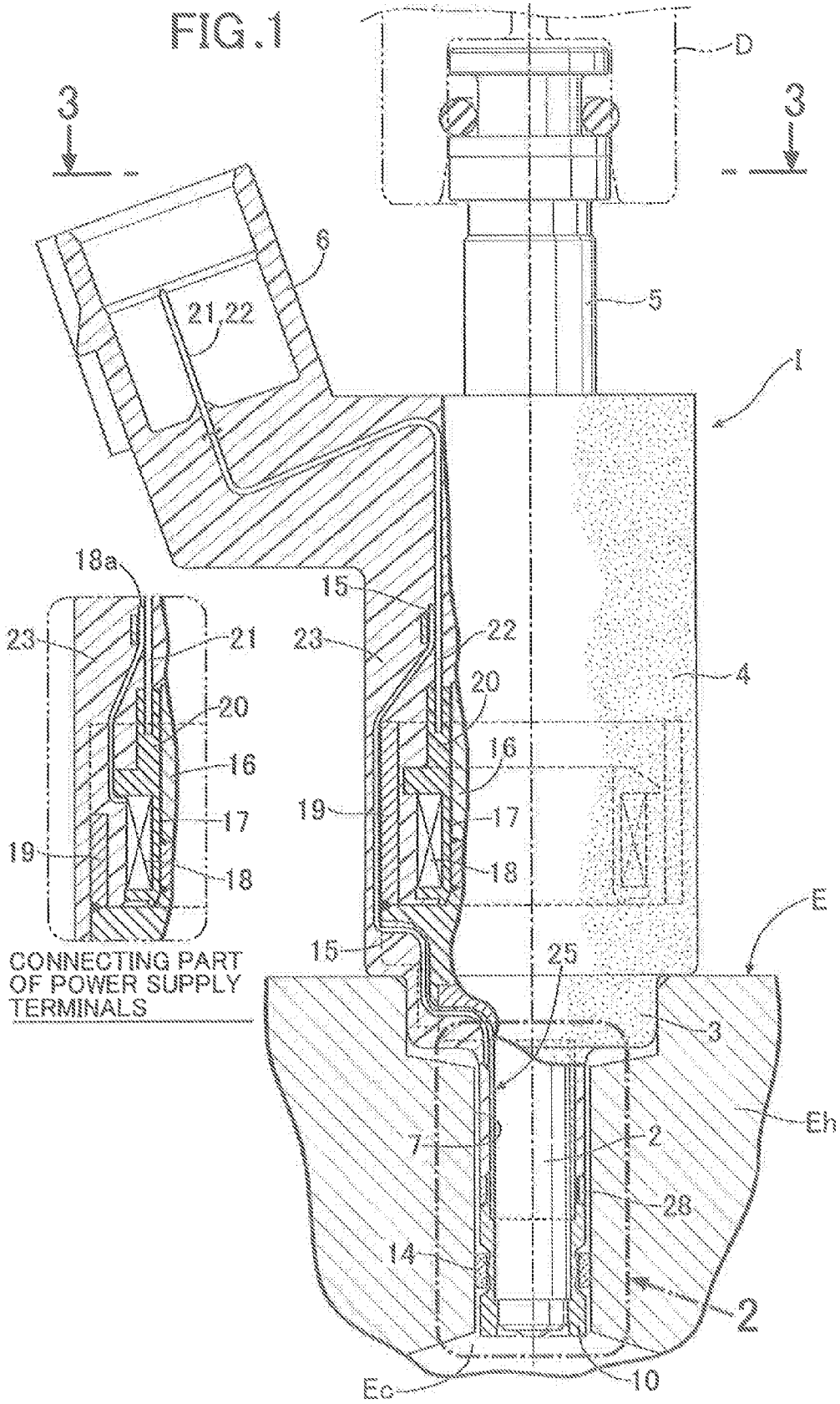
FIG. 1 is a cutaway side view of an essential part of a fuel injection valve equipped with an in-cylinder pressure sensor related to the present invention in a state in which it is fitted into an engine. (first embodiment)

E Engine
Ec Combustion chamber
I Electromagnetic fuel injection valve
2 Valve housing part
7 Injection valve mounting hole
10 In-cylinder pressure sensor
11 Signal circuit tube
23 Insulating layer
25 Signal transmission means
28 Support ring
30 Circumferential weld

MODE FOR CARRYING OUT THE INVENTION

An embodiment of the present invention is explained by reference to the attached drawings.

First Embodiment

First, in FIG. 1, mounted on a cylinder head Eh of an engine E are a fuel injection valve I that can inject fuel directly into a combustion chamber Ec and a fuel distribution pipe D that distributes fuel to the fuel injection valve I. In the fuel injection valve I, the combustion chamber Ec side is defined as the front and the fuel distribution pipe D side is defined as the rear. The fuel injection valve I is formed by coaxially connecting in sequence from the front end toward the rear end a cylindrical valve housing part 2, an intermediate linking part 3, an electromagnetic coil part 4, and a fuel injection tube part 5. When the electromagnetic coil part 4 is energized, a valve within the valve housing part 2 is opened, and the fuel injection tube part 5 injects directly into the combustion chamber Ec fuel that has been fed from the fuel distribution pipe D.

In the fuel injection valve I, the external diameter increases in the order: valve housing part 2, intermediate linking part 3, and electromagnetic coil part 4, the electromagnetic coil part 4 having formed on its rear part a coupler 6 protruding toward one side thereof.

Provided in the cylinder head Eh is an injection valve mounting hole 7 opening on a ceiling face of the combustion chamber Ec, the valve housing part 2 and the intermediate linking part 3 being fitted into the injection valve mounting hole 7, and the fuel injection valve I being mounted on the cylinder head Eh so that a front end face of the electromagnetic coil part 4 abuts against an outer face of the cylinder head Eh.

Figure 2:
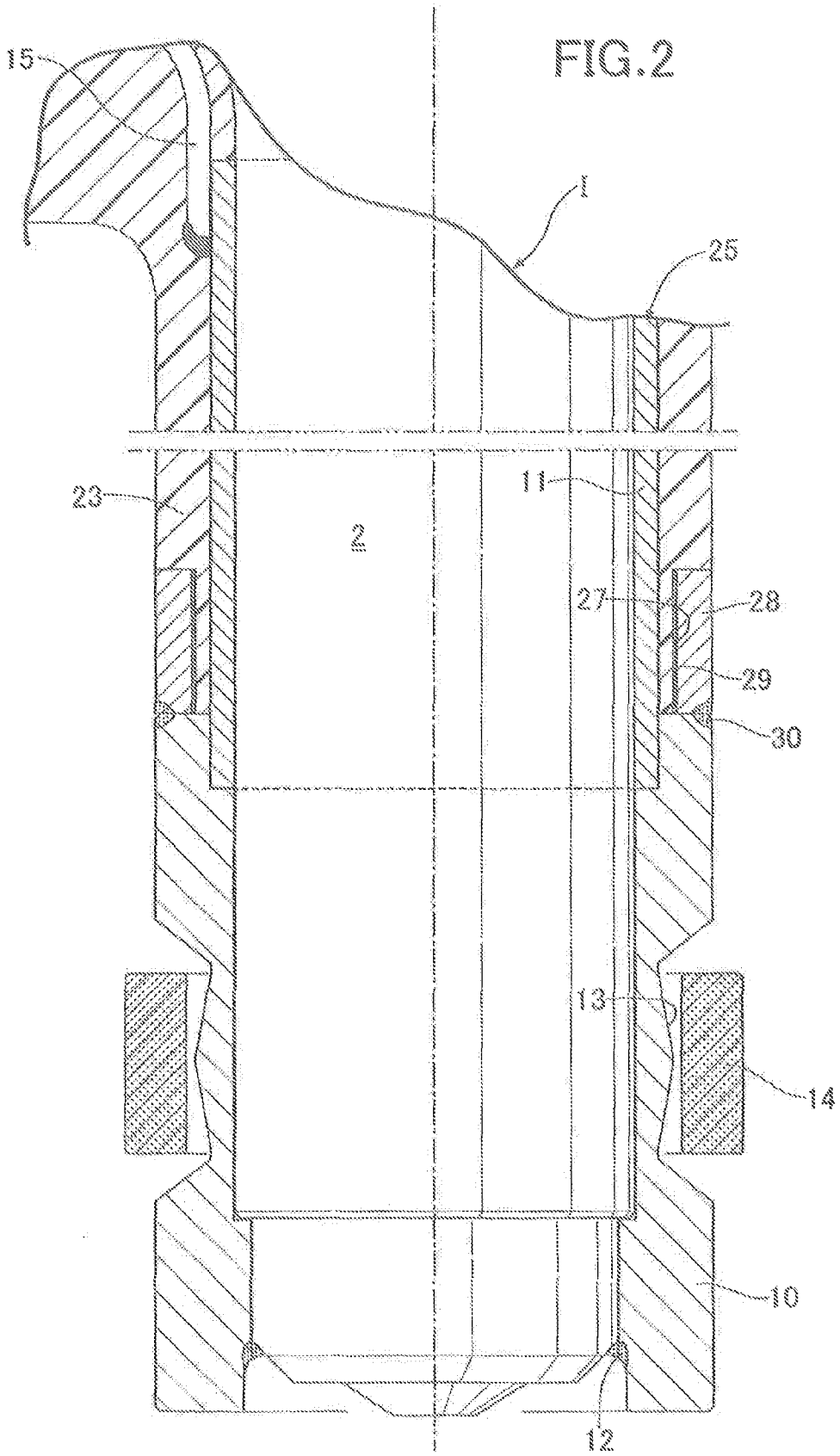
FIG. 2 is an enlarged view of part 2 in FIG. 1. (first embodiment)

As shown in FIGS. 1 and 2, fitted around the outer periphery of the valve housing part 2 are a cylindrical in-cylinder pressure sensor 10 having a front end facing the combustion chamber Ec and a cylindrical signal circuit tube 11 fitted into and electrically connected to the inner periphery of a rear end part of the in-cylinder pressure sensor 10, the inner peripheral edge at the front end of the in-cylinder pressure sensor 10 being joined to the valve housing part 2 by means of a circumferential weld 12. An annular seal groove 13 is formed on the outer periphery of an intermediate part of the in-cylinder pressure sensor 10, and a seal member 14 that is in intimate contact with an inner peripheral face of the injection valve mounting hole 7 is fitted into the annular seal groove 13. The in-cylinder pressure sensor 10 is formed from for example a piezoelectric element.

The rear end of the signal circuit tube 11 extends to a rear end part of the valve housing part 2, and a signal wire 15 extending to the vicinity of the rear end of the electromagnetic coil part 4 via one side of the intermediate linking part 3 and electromagnetic coil part 4 is connected to the rear end of the signal circuit tube 11.

The electromagnetic coil part 4 is formed from a synthetic resin bobbin 17 fitted around the outer periphery of a fixed core 16 that opens the valve within the valve housing part 2 by attraction, a coil 18 wound around the bobbin 17, and a coil housing 19 made of a magnetic material and housing the bobbin 17 and the coil 18. A terminal support part 20 is formed integrally with a rear end part of the bobbin 17, and this terminal support part 20 retains a pair of power supply terminals 21 and a signal terminal 22, the power supply terminals 21 being connected to opposite terminals 18*a* of the wire of the coil 18, and the signal terminal 22 being connected to the terminal of the signal wire 15.

An insulating layer 23, made of a synthetic resin, is molded on outer peripheral faces of the coil housing 19 and the signal circuit tube 11 so as to continuously cover them.

Figure 3:
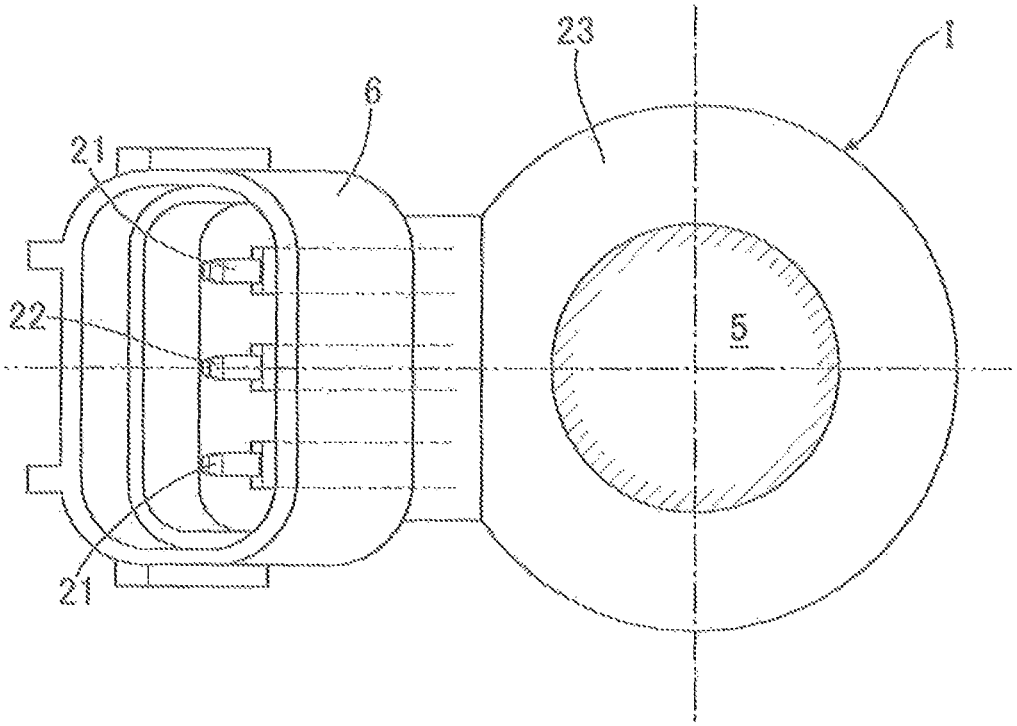
FIG. 3 is an enlarged sectional view along line 3-3 in FIG. 1. (first embodiment)

As shown in FIG. 1 and FIG. 3, the coupler 6 is formed integrally with a rear part of the insulating layer 23 covering the electromagnetic coil part 4, the coupler 6 protruding to one side of the insulating layer 23, base parts of the power supply terminal 21 and the signal terminal 22 being embedded in the coupler 6, and connection end parts thereof being disposed within a connection opening of the coupler 6. In the illustrated example, the connection end part of the signal terminal 22 is disposed between the connection end parts of the pair of power supply terminals 21.

In the above, the signal circuit tube 11, the signal wire 15, and the signal terminal 22 form signal transmission means 25 for transmitting an output signal of the in-cylinder pressure sensor 10 to the outside.

An annular recess 27 is formed on the outer periphery of a front end part of the insulating layer 23, a rear end face of the in-cylinder pressure sensor 10 facing the annular recess 27, in this annular recess 27 a support ring 28 made of a metal (e.g. stainless steel) abutting against the rear end face of the in-cylinder pressure sensor 10 is hermetically fitted around an outer peripheral face of the insulating layer 23 via an adhesive 29, and parts of the support ring 28 and the in-cylinder pressure sensor 10 that abut against each other are joined by a circumferential weld 30.

The operation of this embodiment is now explained.

In the engine E, the fuel injection valve I injects fuel directly into the combustion chamber Ec through a fuel discharge hole opening formed at the front end of the valve housing part 2 with predetermined timing. After the fuel has been discharged and ignited, the in-cylinder pressure sensor 10 is subjected to the pressure within the combustion chamber Ec, is compressed in the axial direction, and outputs a voltage signal that depends on the amount of strain, the output signal is transmitted to an electronic control unit (not illustrated) connected to the signal terminal 22 via the signal circuit tube 11 and the signal wire 15, and the pressure of the combustion chamber Ec, that is, the in-cylinder pressure, is calculated there and is utilized for knocking control, etc. It will be understood from the foregoing that the signal circuit tube 11 is electrically conductive, which enables it to transmit the output signal from the in-cylinder pressure sensor 10 to the signal wire 15.

Since the cylindrical in-cylinder pressure sensor 10, which has the front end facing the combustion chamber Ec, and the cylindrical signal circuit tube 11, which is fitted into and connected to the inner peripheral face of the rear end part of the in-cylinder pressure sensor 10, are fitted around and fixed to the outer peripheral face of the valve housing part 2 of the fuel injection valve I housed in the injection valve mounting hole 7 provided in the cylinder head Eh, it is unnecessary to employ special positioning when fitting and connecting together the in-cylinder pressure sensor 10 and the signal circuit tube 11, which are both cylindrical, and the ease of assembly is good. Moreover, since the signal circuit tube 11 fitted around the outer peripheral face of the valve housing part 2 does not vibrate even when subjected to vibration of the engine E, even if it is housed within the injection valve mounting hole 7, it does not make contact with the inner face of the injection valve mounting hole 7, thus enabling the durability thereof to be maintained.

Furthermore, since the outer peripheral face of the signal circuit tube 11 is covered by the insulating layer 23, it is possible by this insulating layer 23 to reliably prevent the signal circuit tube 11 from making contact with the inner face of the injection valve mounting hole 7 while protecting the signal circuit tube 11.

Moreover, since the inner peripheral edge of the front end part of the cylindrical in-cylinder pressure sensor 10 is joined to the valve housing part 2 by the circumferential weld 12, and the rear end part thereof is joined to the support ring 28 hermetically fitted to the insulating layer 23 on the outer periphery of the signal circuit tube 11 by the circumferential weld 30, the in-cylinder pressure sensor 10 is supported via two positions at the front and rear ends, thereby enhancing the support strength therefor. Furthermore, since the in-cylinder pressure sensor 10 and the valve housing part 2 are hermetically joined by the circumferential weld 12, it is possible to prevent high pressure gas from the combustion chamber Ec entering therebetween.

An embodiment of the present invention is explained above, but the present invention is not limited thereto and may be modified in variety of ways as long as the modifications do not depart from the spirit and scope thereof.

The invention claimed is:

1. A fuel injection valve equipped with an in-cylinder pressure sensor, in which the fuel injection valve is provided for installation into an injection valve mounting hole provided in an engine, the fuel injection valve comprising a valve housing part and directly injecting fuel at a fuel injecting front end of the valve housing part into a combustion chamber of the engine, wherein:

the in-cylinder pressure sensor is coaxially attached to the valve housing part of the fuel injection valve, the in-cylinder pressure sensor having a front end facing the combustion chamber and detecting a pressure of the combustion chamber, and an electrically conductive signal transmission device is connected to the in-cylinder pressure sensor, the signal transmission device transmitting an output signal thereof to an outside, and further wherein the front end of the in-cylinder pressure sensor is substantially aligned with the fuel injecting front end of the valve housing part, the electrically conductive signal transmission device is disposed on an outer face of the valve housing part and, at a whole of the signal transmission device excluding a portion thereof connected to the in-cylinder pressure sensor, covered together with a part of the valve housing part by an insulating layer made of a synthetic resin.

2. The fuel injection valve equipped with an in-cylinder pressure sensor according to claim 1, wherein the insulating layer forms at least a part of a coupler, and a power supply terminal for energizing a coil and a signal terminal for transmitting an output signal are disposed in the coupler.

* * * * *